United States Patent [19]

Meywald et al.

[11] 4,191,880

[45] Mar. 4, 1980

[54] HEATING ELEMENT FOR ELECTRICAL APPLIANCE HAVING A BLOWER

[75] Inventors: Klaus Meywald; Helmut Ohnmacht, both of Kandel, Fed. Rep. of Germany

[73] Assignee: Firma Fritz Eichenauer, Fed. Rep. of Germany

[21] Appl. No.: 904,882

[22] Filed: May 11, 1978

[51] Int. Cl.[2] ..... H05B 3/02; F24H 3/04

[52] U.S. Cl. ..... 219/375; 219/381; 219/532; 219/541; 219/551; 338/58; 338/290; 338/323

[58] Field of Search ..... 219/369–371, 219/374–376, 379–382, 532, 538, 592, 546, 541; 338/315–321, 279–294, 57, 58, 322–325, 332

[56] References Cited

U.S. PATENT DOCUMENTS

| | | | |
|---|---|---|---|
| 1,134,886 | 4/1915 | Merrill | 338/299 |
| 3,324,441 | 6/1967 | Olsen et al. | 338/332 |
| 4,075,459 | 2/1978 | Lieber | 219/375 |
| 4,109,138 | 8/1978 | Ohnmacht | 219/370 |

FOREIGN PATENT DOCUMENTS

| | | | |
|---|---|---|---|
| 2307992 | 8/1974 | Fed. Rep. of Germany | 219/375 |
| 2461754 | 8/1976 | Fed. Rep. of Germany | 219/375 |
| 2535478 | 2/1977 | Fed. Rep. of Germany | 219/370 |

*Primary Examiner*—Bruce A. Reynolds
*Assistant Examiner*—Bernard Roskoski
*Attorney, Agent, or Firm*—Craig and Antonelli

[57] ABSTRACT

A heating element for electrical appliances which include a meander-form winding of resistance heating wire, two or more supporting plates arranged parallel to an incident flow direction of air produced by the blower and having openings in which turns of the winding are located. Metallic spacer elements are provided for connecting the supporting plates with a voltage tap being provided on at least one of the turns of the winding. At least one of the spacer elements is provided with a prolongation which projects beyond one of the supporting plates and is deformable to constitute a sleeve engaging about a turn of the winding.

6 Claims, 4 Drawing Figures

HEATING ELEMENT FOR ELECTRICAL APPLIANCE HAVING A BLOWER

This invention relates to heating elements for electrical appliances having blowers—for example, for fan heaters, hair driers or the like—the element comprising a resistance heating wire wound in meander (i.e. zig-zag or sinuous) fashion, two or more supporting plates arranged parallel to the direction of incident flow of air produced by the blower and holding in openings a plurality of turns of the heating wire winding arranged in succession, and metallic spacer elements connecting the supporting plates, a voltage tap being provided at selected turns for the fan motor and/or for the power stage regulation of the heating element.

A large number of constructional forms of heating elements arranged in this way have been proposed. While the resistance wire itself is supplied with main voltage, the driving motor for the blower is often a low-voltage direct-current motor. It is also supplied with current from the main, a suitable voltage being tapped by way of a specific heating wire length and rectified by means of diodes. Similar taps can be provided for the regulation of the stages of heating power of the resistance heating wire or for varying motor speed. In one such arrangement, tubular rivets are fitted over the bights or tips of the selected turns and pressed together with the heating wire. These rivets serve as electrical connectors for tapping the appropriate voltage. This construction of the voltage tap arrangement has been found useful, but the use of the tubular rivets involves additional components which have to be assembled additionally.

An object of the invention is to provide a simpler and cheaper voltage tap for a heating element of the kind described initially above.

This object is achieved according to the invention in that the spacer elements connecting the supporting plates comprise a prolongation which projects beyond one of the plates and which is deformable to constitute a sleeve engaging about a turn of the winding.

With the invention, the spacer elements required for connecting the plates and keeping them spaced are utilised at the same time for voltage tapping purposes, the spacer elements having a prolongation which can be formed into a sleeve. Either this deformation of the prolongation to form a sleeve is effected before the assembly of the heating element, so that the spacer element with the sleeve is first fitted on to the selected turn and then connected to the plate, or the spacer element is first connected to the plates and then the prolongation is deformed to act as a sleeve extending about the selected adjacent turn.

There are heating elements in which, parallel to the supporting plates and beyond the bights of the winding, there is arranged an additional plate of insulating material to act as a cover plate and/or as a mounting plate for accommodating circuit elements such as diodes, temperature protection switches or the like. In a heating element of that kind it is proposed, according to the present invention, that the prolongation of the spacers comprises a lug for electrical connection purposes, this lug projecting beyond the bights and extending through the plate of insulating material. Thus, the connections are taken through to the mounting plate for the circuit elements, so that the electrical connections can easily be attended to.

In the constructional forms which have been proposed, each spacer element is usually punched or stamped from a sheet metal strip, with a U-shaped bent-round portion to engage at the edges over the respective supporting plate. In that kind of punching it is proposed, according to the invention, to provide the prolongation with at least one tab adapted to be deformed to constitute the eyelet sleeve. With this feature of the invention it is possible still to produce the spacer element as a punched part.

The lug can be narrowed stepwise relatively to the prolongation, the plate of insulating material being placed on the step thus formed. Thus the prolongation, or the transition between it and the lug, forms at the same time the bearing surfaces for the additional insulation plate or mounting plate.

In accordance with further features of the present invention, the heating element may be in the form of a closed figure, such as a circle or a square, and may include two spacer elements located at opposite points in the closed figure whereby two voltage taps may be provided. Additionally, it is also possible to provide two windings which are successively arranged.

The invention will now be described, by way of example, with reference to a constructional form shown in the drawings, in which.

Figure 1:
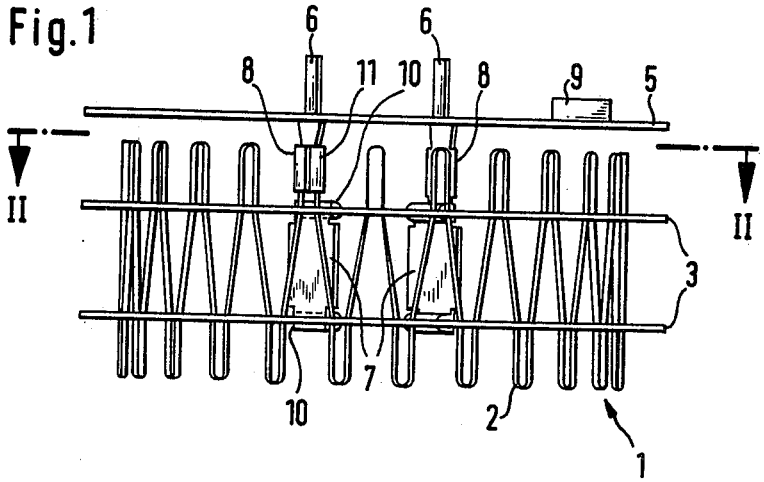
FIG. 1 shows a side view of a round heating element.
Figure 2:
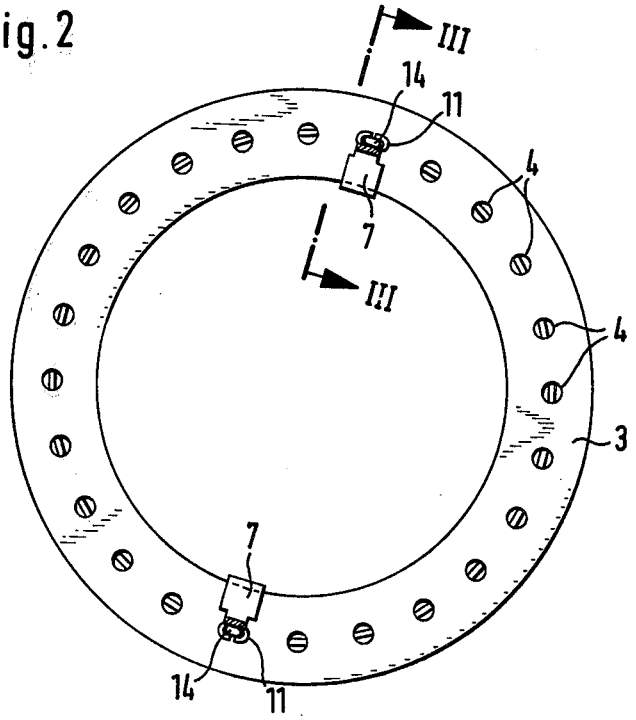
FIG. 2 shows a section on II—II of FIG. 1.

Referring now to the drawings wherein like reference numerals are used throughout the various views to designate like parts and, more particularly, to FIGS. 1 and 2, according to these figures, a heating element generally designated by the reference numeral 1 has a circular shape. It could, however, equally well be given a square box-shaped form. The heating element 1 consists essentially of a resistance heating wire 2 and two supporting plates spaced from one another. The resistance heating wire 2 is meander wound and, in the illustrated constructional example, given a suitably closed-circle form. As a departure from the constructional form shown in FIGS. 1 and 2 it is possible to provide a plurality of concentric rows of winding turns if necessary. The resistance heating wire 2 is fixed in openings 4 of the supporting plates 3, for example each out and back pair of runs of the wire being inserted with the bight or tip foremost into an opening. Above the bights of the turns situated at one side there is arranged a further plate 5, of insulating material, to act as a mounting plate for circuit elements, one of which, a temperature protection switch 9, is shown by way of example in FIG. 1.

Figure 3:
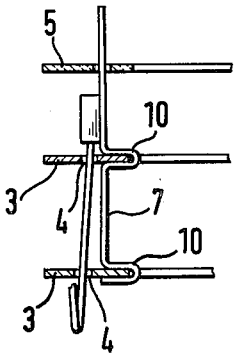
FIG. 3 shows a section on III—III of FIG. 2.

The supporting plates 3 are each connected together by a spacer element 7 which, as shown most clearly in, FIG. 3 comprises respective U-shaped bent-round portions 10 arranged at suitable intervals. With these U-shaped bent portions 10, the spacer element 7 engages about the edges of the supporting plates 3. The spacer element 7 has a prolongation generally designed by the reference numeral 8 which projects above the upper plate 3. The prolongation 8 is also continued by a lug 6 which extends through the upper plate 5 of insulating material.

Figure 4:
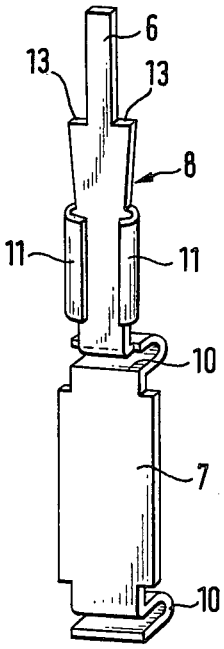
FIG. 4 shows a perspective view of a spacer element.

In the region of the prolongation 8, tabs 11 are punched out which, as shown most clearly in FIG. 4, are or can be bent round inwardly. A step 13 is also provided between the prolongation 8 and the lug 6. The entire spacer element 7 can be produced in a simple manner by punching, and all that has to be done subsequently is to shape the two U-bends 10 and the tabs 11. Preferably the punched part is brought to the shape shown in FIG. 4 before assembly.

At assembly of the heating element, the supporting plates 3 are first fitted from both sides over the bights of the turns of the heating wire 2, until they are approximately at the desired spacing. Then the spacer elements 7 with their tabs 11 are fitted on to the respective selected bights 14 (FIG. 2), and then have their U-shaped bends 10 fitted over the edges of the supporting plates. In this position, the U-shaped bends 10 and tabs 11 may be subjected to a subsequent deformation operation if necessary. Then the plate 5 of insulating material is fitted on to the lugs 6 until it lies on the step 13. Then the lugs 6 forming the voltage tap for the fan driving motor, and/or for power stage regulation of the heating element, can be connected to the appropriate components on the plate 5 of insulating material and the main voltage respectively.

It will be appreciated that the air flow, produced by the fan or blower of an electrical appliance in which the heating element 1 is employed, will be radial with respect to the circular heating element 1, and therefore parallel to the supporting plates 3.

What is claimed is:

1. A heating element for an electrical appliance having a blower, the heating element comprising a meander-form winding of resistance heating wire, a plurality of supporting plates arranged in parallel to an incident flow direction of air produced by the blower, the supporting plates being provided with openings for accommodating turns of the winding, and metallic spacer elements for connecting the supporting plates, a prolongation provided on at least one of the spacer elements and including a first portion projecting beyond one of the supporting plates, and a second portion which is deformable so as to form a sleeve engaging a turn of the winding whereby the spacer element forms a voltage tap for the heating element.

2. A heating element according to claim 1, wherein each spacer element is formed by punched out sheet metal and includes spaced U-shaped portions for engaging edges of the respective supporting plates, and wherein the second portion of said prolongation is formed by at least one deformable tab provided on the prolongation.

3. A heating element according to claim 1, including at least one plate of insulating material arranged parallel to the supporting plates and spaced from adjacent bights of the turns of the winding, and wherein the first portion of said prolongation is formed as a lug extending through the plate of insulating material.

4. A heating element according to claim 3, wherein said prolongation includes a step from which the lug extends for supporting the plate of insulating material.

5. A heating element according to claim 1, wherein said winding extends to form a closed figure around a central space, said supporting plates being shaped correspondingly to said figure, and wherein two spacer elements are disposed at opposite points in said figure.

6. A heating element according to claim 1, including a plurality of successively arranged windings of resistance heating wire with turns of the windings being accommodated in openings in the supporting plates.

* * * * *